US009255430B2

(12) United States Patent
Lucas

(10) Patent No.: US 9,255,430 B2
(45) Date of Patent: Feb. 9, 2016

(54) FOLDING DOOR WITH TWO OR MORE INTRINSICALLY RIGID FOLDING SHUTTER ELEMENTS WITH ALTERNATELY NONCOLLAPSING OR COLLAPSING ELEMENT EDGES AND ACTUATION DEVICE FOR SAME

(71) Applicant: Belu Verwaltungsgesellschaft mbH, Lingen/EMs (DE)

(72) Inventor: Bernhard Lucas, Lingen/Ems (DE)

(73) Assignee: Belu Verwaltungsgesellschaft mbH, Lingen/Ems (DE)

( * ) Notice: Subject to any disclaimer, the term of this patent is extended or adjusted under 35 U.S.C. 154(b) by 164 days.

(21) Appl. No.: 13/782,548

(22) Filed: Mar. 1, 2013

(65) Prior Publication Data

US 2013/0228292 A1 Sep. 5, 2013

(30) Foreign Application Priority Data

| | | |
|---|---|---|
| Mar. 2, 2012 | (DE) | 20 2012 002 090 U |
| May 14, 2012 | (DE) | 20 2012 004 753 U |
| Jan. 17, 2013 | (DE) | 20 2013 000 449 U |

(51) Int. Cl.

| | |
|---|---|
| ***E06B 9/06*** | (2006.01) |
| ***E05D 15/26*** | (2006.01) |
| ***E05D 15/06*** | (2006.01) |
| *E06B 3/48* | (2006.01) |

(52) U.S. Cl.

CPC ..... *E05D 15/26* (2013.01); *E05D 15/0686* (2013.01); *E05D 15/262* (2013.01); *E06B 9/0638* (2013.01); *E06B 9/0676* (2013.01); *E05Y 2201/688* (2013.01); *E05Y 2201/71* (2013.01); *E05Y 2900/132* (2013.01); *E05Y 2900/146* (2013.01); *E06B 3/481* (2013.01)

(58) Field of Classification Search

CPC ..... E06B 9/0676; E06B 9/0638; E06B 3/481; E05D 15/26; E05D 15/262; E05D 15/0686

USPC ..... 160/40, 203, 207, 209, 213; 49/216, 49/221, 222, 203, 125–127

See application file for complete search history.

(56) References Cited

U.S. PATENT DOCUMENTS

| | | | | |
|---|---|---|---|---|
| 1,700,184 | A * | 1/1929 | Sipes | 160/199 |
| 2,333,312 | A * | 11/1943 | Grinstead | 160/206 |

(Continued)

FOREIGN PATENT DOCUMENTS

| | | |
|---|---|---|
| WO | 2008/125343 A1 | 10/2008 |
| WO | 2012/095324 A1 | 7/2012 |

*Primary Examiner* — Katherine Mitchell
*Assistant Examiner* — Abe Massad
(74) *Attorney, Agent, or Firm* — Rankin, Hill & Clark LLP

(57) ABSTRACT

A folding door with two or more intrinsically rigid folding shutter elements with alternating noncollapsing and collapsing element edges, with at least one guide means which can be raised and lowered on or in one or more guide rail(s), for moving a, in particular the lower, permanently guide rail-adjacent, noncollapsing door element edge, wherein at least one release movement means, which is provided for the initial release movement of the permanently guide rail-adjacent door element edge from the guide rail(s), at the beginning of the opening of the folding door, and for the final advance movement of the permanently guide rail-adjacent door element edge at the end of the closing of the folding door, and an actuation device and method for the same.

14 Claims, 9 Drawing Sheets

(56) References Cited

U.S. PATENT DOCUMENTS

| | | | | | |
|---|---|---|---|---|---|
| 2,581,797 | A | * | 1/1952 | Jordan | 160/206 |
| 3,275,064 | A | * | 9/1966 | Hansen | 160/206 |
| 4,551,945 | A | * | 11/1985 | von Resch | 49/221 |
| 4,794,730 | A | * | 1/1989 | Fischbach | 49/130 |
| 4,802,307 | A | * | 2/1989 | Schmidt | 49/219 |
| 5,363,898 | A | * | 11/1994 | Sprague | 160/98 |
| 6,332,660 | B1 | * | 12/2001 | Salice | 312/328 |
| 6,336,246 | B1 | * | 1/2002 | Giovannetti | 16/87 R |
| 8,381,927 | B2 | * | 2/2013 | Nam | 220/1.5 |
| 2006/0175867 | A1 | * | 8/2006 | Heuel et al. | 296/155 |
| 2013/0292067 | A1 | * | 11/2013 | Lucas | 160/213 |

* cited by examiner

FOLDING DOOR WITH TWO OR MORE INTRINSICALLY RIGID FOLDING SHUTTER ELEMENTS WITH ALTERNATELY NONCOLLAPSING OR COLLAPSING ELEMENT EDGES AND ACTUATION DEVICE FOR SAME

FIELD OF THE INVENTION

The invention relates to folding doors as well as to actuation devices for the same. In particular, to a folding door with two or more intrinsically rigid folding elements with alternately noncollapsing and collapsing element edges. At least one guide means which can be raised and lowered on or in one or more guide rails moves a, in particular the lower, permanent guide rail-adjacent door element edge which is thus noncollapsing, and which comprises at least one pivot point for raising and lowering the permanently guide rail-adjacent noncollapsing door element edge.

As used herein, the term "collapsing" and cognate terms refer to elements that remain near/adjacent to the guide rails during a folding of the door, as in a set of foldable shutter elements, panels, or doors. As used herein, the term "noncollapsing" and cognate terms refer to elements that extend away from, and do not remain adjacent to the guide rails during a folding of the door, as in a set of foldable shutter elements, panels, or doors.

Usually, a first folding shutter element is indirectly or directly attached or attachable, in a pivotable manner, around a first near stationary axle, close to a noncollapsing (first) element edge, on a building, for example. A second folding shutter element is pivotably held around an axle which can be displaced transversely to itself, close to a noncollapsing second element edge, and displaced along guides arranged, as a rule in pairs, perpendicularly to the second element edge. The adjacent folding shutter elements, at their collapsing third element edges which are arranged parallel to and opposite the first and second element edges, are pivotably connected in pairs to each other by means of a collapsing joint. In principle, additional folding shutter element pairs can be attached to the previous folding shutter element pair. Furthermore, it is possible that, on the folding shutter element pair(s), a last folding element which protrudes freely at the end, is connected pivotably to the folding shutter element pair(s) close to the noncollapsing second, fourth or additional element edge.

TECHNOLOGICAL BACKGROUND

Folding doors according to the preamble are known from WO 2008/125343 A1 of the same applicant and from the International Patent Application PCT/EP2012/000157 of the applicant of Jan. 16, 2012, whose content is included here by reference in the present patent application. According to WO 2008/125343 A1, adjustment sections are needed during the installation of the folding shutter in or in front of a building opening. There are no possibilities for sealing the closed folding door on the margin. All of these documents are incorporated by reference into the specification of this application.

DESCRIPTION OF THE INVENTION

The invention is based on the problem of improving the start of the opening of the door and the completion of the closing of the door that is at least the beginning or the start phase of the opening of the door, and the end or final phase of the closing of the door.

According to certain aspects of the invention of this application, provided is a folding door with two or more intrinsically rigid folding shutter elements, with alternating noncollapsing and collapsing element edges, with at least one guide means which can be raised and lowered on or in one or more guide rail(s), for moving a, in particular the lower, permanently guide rail-adjacent, noncollapsing door element edge which comprises at least one pivot point for raising and lowering the permanently guide rail-adjacent, noncollapsing door element edge, and a displacement means, which is active between the pivot point and the guide means which can be raised and lowered on the guide rail(s), for displacing the pivot point with respect to the guide means in terms of separation, during the opening, particularly at the beginning of the opening phase, of the folding door, as well as during the closing, particularly at the end of the closing phase, of the folding door.

According to other aspects of the invention of this application provided is an actuation device for a folding door reference above.

Accordingly, the invention provides for at least one displacement means in the case of a folding door. At the beginning of the opening of the folding door, this displacement means displaces the pivot point of the corresponding permanently guide rail-adjacent door element edge with respect to the guide means in terms of separation. This preferably occurs by movement, that is a lateral displacement and/or by a vertical displacement. At the end of the closing of the folding door, the displacement means accordingly displaces the pivot point of the affected permanently guide rail-adjacent door element edge back in the reverse direction. Due to the invention, several advantages are achieved which are evident. For example, an initial lateral release movement of the permanently guide rail-adjacent door element edge from the guide rail by a certain distance leads, for example, to the possibility that the lower door element edge is brought relatively close to the guide rail(s), in the closed state, and, for example, to a door side edge seal, without representing an impediment during the opening of the door. The advantage occurs not only at the beginning of the opening movement; it also occurs at times that include the end of the opening movement and the time when the folding door is in the maximum open position. An initial relative raising of the pivot point with regard to the guide means leads to the possibility that the pivot point can be arranged at a relatively low point, with respect to the guide means, when the door is closed. Nevertheless, the pivot point can be moved advantageously upward at the end of the opening path and/or the thrust forces of the lower door edge can advantageously act on the guide means, and allow a simple configuration of the guide means.

The invention can then be carried out in different manners. In particular, it is advantageous to design guide means that can be raised and lowered as guide carriages, particularly with tandem castors and/or double castors.

According to a particularly advantageous embodiment of the invention, the guide means consists of at least two guide elements which, during the opening of the door, are to move relatively toward each other, at least along a partial section of the opening path, and which, during the closing of the door, are again to move relatively apart from each other, at least along a partial section of the closing path. In principle, the opposite movement course of the guide means is also possible. The guide elements perform, indirectly or directly, while they are moving toward each other (or apart from each other), a door actuation accompanying the opening of the door, and while they are moving apart from each other (or are moving toward each other), a door actuation accompanying the closing of the door. The solution on its own is also inventive, independently of the displacement means. The effects of the door actuation accompanying the opening of the door can include an unlocking, a collapsing out of the extended position, a forced pivoting of at least one of the folding shutter elements and/or a movement of at least one permanently guide rail-adjacent door element edge away from the guide rail(s). The effects of the door actuation accompanying the closing of the door can include a locking, a pulling into the extended position, a forced pivoting of at least one of the folding shutter elements and/or a movement bringing at least permanently guide rail-adjacent door element edge closer to the guide rail(s). These guide rails as well can comprise castors, particularly tandem castors and/or double castors, and they can be implemented in particular as a multipart guide carriage.

A particularly simple actuation of the displacement means is achieved if the latter comprises a transmission, particularly a gear transmission. The latter can be co-actuated by the raising and lowering process during the opening and closing of the door. This occurs preferably by means of one and the same drive unit. If the transmission is designed as a gear transmission, then, as a result, a lever attached by a pivot in a first guide element can engage at the other end at the pivot point of the noncollapsing permanently guide rail-adjacent door element edge. As a result of the pivot movement generated by the transmission, the element edge at the same time can be displaced to the side and raised, when the door is open. The transmission, particularly the gear transmission, can be arranged exclusively on the first guide means, in particular on a guide carriage. The drive unit of such a transmission, in particular of a gear transmission, can be made by means of a linear drive means which can be raised and lowered along the at least one guide rail. The linear drive means can be used as a second guide element; in particular, it can be raised and lowered on or in the first guide element along a free travel path. The first and second guide elements then form a combined drive unit assembly, in which the second guide element is mounted on the first guide element. The mounting of the element edge can occur independently of the raising and lowering movement of the folding element. The first guide element, that is in particular a guide carriage, can be displaced in the lateral guide rails of the door. Advantageously the drive means of the door, preferably the sole drive means of the door, particularly a traction band, which preferably works in circulation, engages on the second guide element. Due to the free travel path, only the displacement function is then carried out, and in combination therewith an unlocking and collapsing function and/or a pulling close and locking function is/are optionally carried out. At the end of the free travel path, the second guide element then raises the first, namely in particular a guide carriage, and thus it raises the door in the opening direction. The same functionality can be achieved if the transmission is designed as a lever transmission, particularly an elbow lever transmission. In both cases, force amplifiers can be used additionally. In any case, means for increasing the closing force in particular, in or near the closed position, are advantageous. Control and/or stopping means are also useful to ensure the sequence of movements of the first and/or second guide elements.

By means of the invention, it is thus not only possible, at the beginning of the opening of the folding door, to bring about a movement away or a relative raising of the permanently guide rail-adjacent door element edge, with respect to the guide means, as well as the corresponding return movement at the end of the closing of the folding door; but it is also possible alternatively or in addition to carry out other door functions thereby. Thus it is possible, for example, at the time of the start of the opening of the door, to actuate the unlocking of one or more locking elements of the folding door in the opening direction and/or to at least start the collapsing movement out of an extended position of the folding door into a collapsed position. Accordingly, at the end of the closing of the folding door, it is possible not only to achieve a counter advance movement of the permanently guide rail-adjacent door element edge toward the guide rail; but it is also possible alternatively or cumulatively to pull the collapsed element edges under remote control against the guide rail, and/or to lock at least one of the folding surfaces with the guide rail or in another manner.

Other advantages include that, as a result of the movement of the two guide elements towards each other or the movement of the two guide elements apart from each other (possibly after a previous unlocking step which in itself is known, for example, during a free travel section), the opening movement itself of the door can be initiated particularly gently. The lower, noncollapsing door element edge is thus raised gently, and not in a jerky manner, in the opening direction. In this manner, a special control of the drive motor for a gentle initiation of the door opening can be dispensed with. Another advantage of the guide elements divided into two portions can consist in that the lower collapsing door element edge can be opened particularly widely, and thus the packet of several folding shutters that is present in the open state is relatively flat.

The invention also makes it possible to carry out, instead of or in addition to the relative displacement of a door edge with respect to the guide means and/or the guide rails, other door actuations that take place before or during the opening or the closing of the door, such as the locking and unlocking, collapsing, and pulling close of the folding shutter elements.

The above-mentioned components as well as the components claimed and described in the embodiment examples, which are to be used according to the invention, are not subject to any particular exceptional conditions with regard to their size, shape, material selection and technical design, so that the selection criteria known in the field of application can be used without restriction.

Additional details, characteristics and advantages of the subject matter of the invention arise from the dependent claims as well as from the subsequent description and the associated drawing in the embodiment examples of the folding doors. In addition, individual characteristics of the claim or of the embodiments can be combined with other characteristics of other claims and embodiments.

Further, these and other objects, aspects, features, characteristics and advantages of the invention will become apparent to those skilled in the art upon a reading of the Detailed Description of the invention set forth below taken together with the drawings which will be described in the next section.

BRIEF DESCRIPTION OF THE FIGURES

The invention may take physical form in certain parts and arrangement of parts, a preferred embodiment of which will be described in detail and illustrated in the accompanying drawings which form a part hereof and wherein:

FIGS. 1A-C show a first embodiment example of an actuation device for a folding shutter arrangement in a basic representation, wherein FIG. 1A represents the situation with closed folding shutter arrangement, FIG. 1B the start phase of the opening of the door, and FIG. 1C a view from above, according to FIG. 1A;

FIGS. 2A-C show a second embodiment example of a folding shutter arrangement, wherein FIG. 2A shows the closed state in a side view, FIG. 2B the locked state, and FIG. 2C the completely opened state;

FIGS. 3A-D show a third embodiment, wherein FIG. 3A (similar to FIG. 2B) shows the merely unlocked state, while in FIG. 3B a transition state between the unlocking and the fast-run phase of the opening of the door can be seen, in which the release movement process occurs, and wherein FIG. 1C shows the situation at the end of the release movement process (slow raising phase) and at the beginning of the fast raising phase, while FIG. 3D shows an intermediate position of the folding shutter arrangement during the fast raising phase;

DETAILED DESCRIPTION OF PREFERRED EMBODIMENTS

Figure 1A:
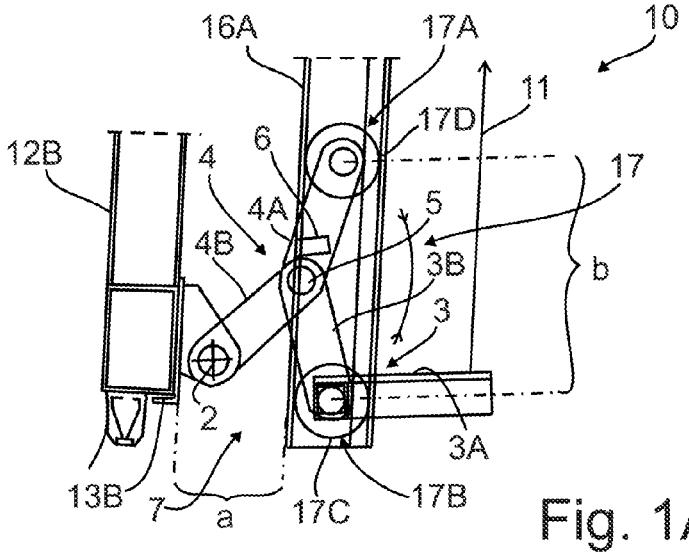
Figure 1B:
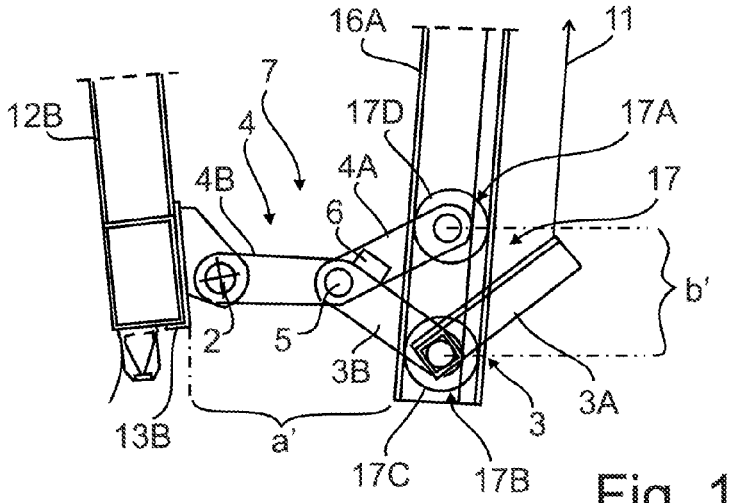
Figure 1C:
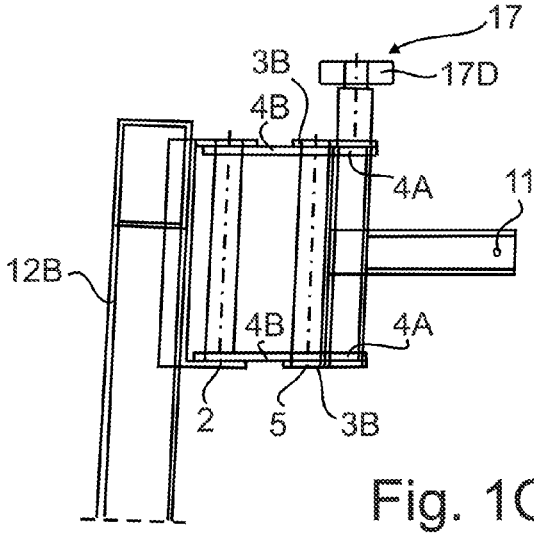

Referring now to the drawings wherein the showings are for the purpose of illustrating preferred and alternative embodiments of the invention only and not for the purpose of limiting the same, FIGS. 1A-1C show, according to a first embodiment example, details of a folding door 10, with a guide rail 16A firmly attached to the building, in the area of a first vertical boundary. A second guide rail 16B, parallel to the former, lies parallel to and opposite the first guide rail. The folding door 10 has at least one pair of intrinsically rigid folding shutter elements 12A, 12B, of which the lower folding shutter element 12B can be seen in the drawing. The arrangement of the folding shutter elements, which in itself is known, is also explained as an example below in connection with the subsequent figures. In the lower area of the folding shutter element 12B, a pivot joint/pivot point 2 is located, by means of which the folding shutter elements 12A, 12B can be pulled up by winding a traction band 11, wherein the pivot joint, as will become apparent, is a noncollapsing element which remains permanently close to the guide rail during the opening and the closing of the door. For purposes including the guiding of the pivot joint, two guide elements 17A, 17B are provided in the guide rail(s) 16A, 16B which in themselves is (are) known, and which, in the concrete embodiment example, comprise guide rollers 17C and 17D, the mutual separation of which is variable, as illustrated by a comparison with FIG. 1B. The guide element 17B comprises a two-armed bent lever 3 whose pivot joint forms the guide roller 17C. One of the two lever arms (3A) is connected at its end area to the traction end of the traction band 11, while the second lever arm (3B) engages pivotably at the pivot point (pivot joint 5) of an additional bent two-arm lever 4. The free end of its first lever arm 4A carries the guide roller 17D, while the free end of the other lever arm 4B is a component of the pivot joint 2.

As can be seen in FIG. 1B, the winding of the traction band 11 leads to a pivoting of the two-arm lever 3 (counterclockwise in the drawing). As a result, the pivot joint 5 which connects the two two-armed levers 3 and 4 drifts to the side in the direction of the folding shutter element 12B. At the same time, the two-arm lever 4 pivots (clockwise in the drawing) and the separation between the two guide elements 17A and 17B is decreased while at the same time the lower area of the folding shutter element 12B moves away to the side up to a maximum separation from the guide rail 16A; this maximum separation is reached in FIG. 1B. It can be advantageous to establish the maintenance of a minimum separation b' between the two guide elements 17A, 17B by an abutment 6 that is active between them. Furthermore, it can be advantageous to stop one of the two guide elements 17A, 17B in a releasable manner, in order to ensure definite movement conditions during the release movement process. However, in FIGS. 1A-1C, no such stopping means is shown, because it is expendable, as long as the force required for the release movement of the folding shutter element from the guide rail is sufficiently small in comparison to the force required to lift the door, even taking into account frictional forces. Accordingly, in this embodiment example, the displacement means 7 comprises substantially the two two-armed levers 3 and 4.

As can be seen furthermore, the pivot point 2 is raised and lowered with respect to the center of gravity of the guide elements 17A, 17B, when the latter move toward each other or away from each other. The displacement means 7 is thus simultaneously a release movement means 7A and a raising means 7B.

Figure 2A:
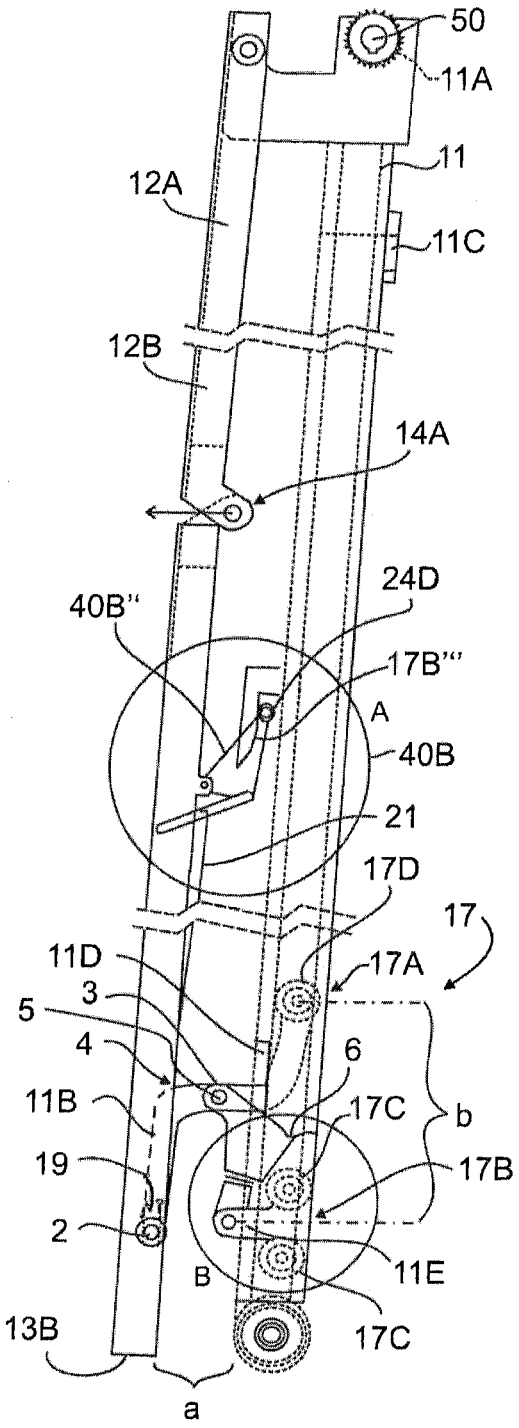
Figure 2B:
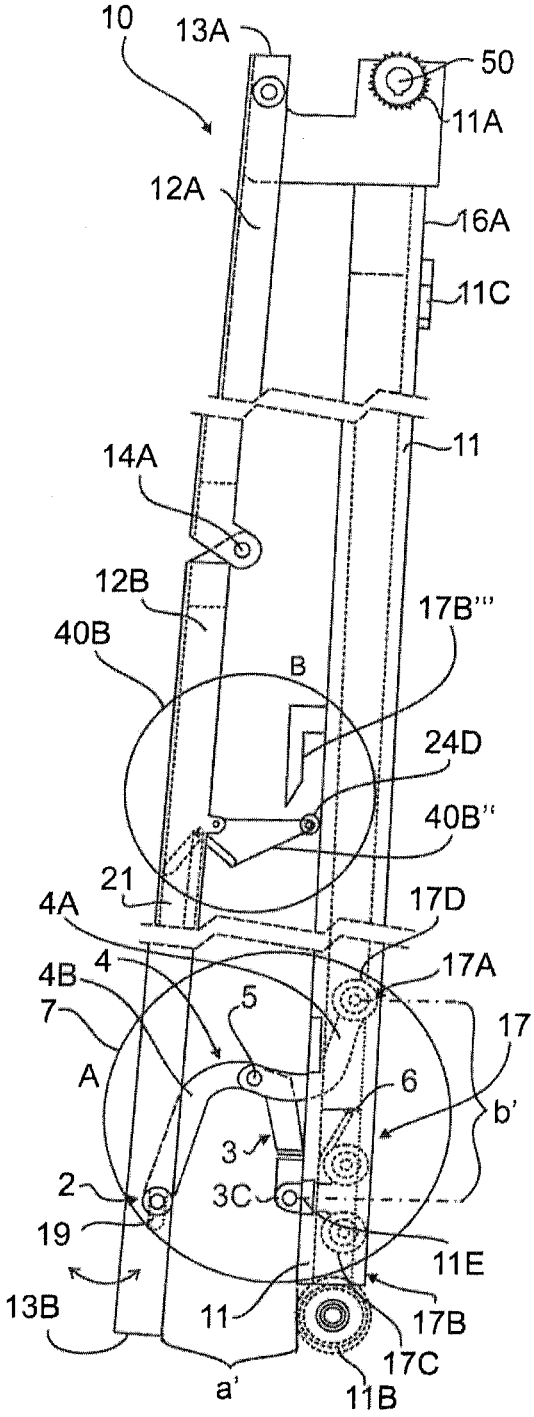
Figure 2C:
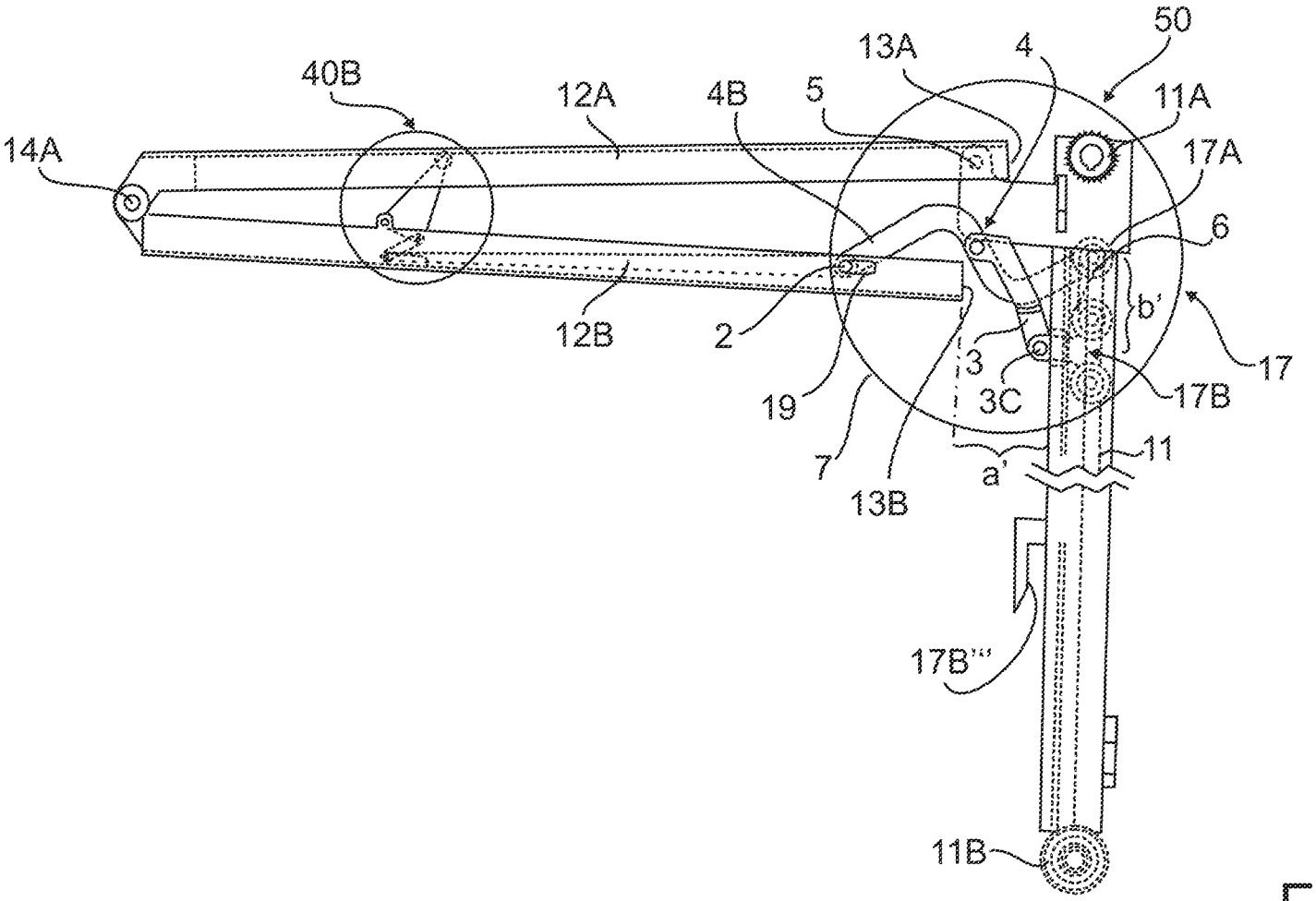

FIGS. 2A-2C show a second embodiment, in which the folding door 10 is represented as a whole with two folding shutter elements 12A and 12B. A drive unit indicated with reference numeral 50 at the upper guide rail end moves an endless fraction band 11, which wraps around a deflection roller 11B at the lower guide rail end as well as a deflection roller 11A at the lower guide rail end. Traction band connectors 11C, 11D can be provided, for example, in order to implement a portion of the traction band in the form of a rope, such as a wire rope, and the other portion of the traction band, in the form of a toothed belt. This simplifies the drive unit which is provided in the drawing at the upper guide rail end, and the rope deflection at the lower guide rail end. In this embodiment example, the (upper) guide element 17A is designed as a double castor, i.e., with two coaxial castors, and the (lower) guide element 17B as a guide carriage with tandem castors, which can each be double castors, for example. The traction band 11 is attached in an appropriate manner by clamps 11E to the guide carriage 17B, and it makes it possible to raise and lower the latter carriage by driving the circulating traction band in one direction or in the opposite direction. A two-arm lever 4 has a cranked configuration in the present case. On its pivot joint 5, a free end of a one-arm lever arm 3 engages, the other end of which engages with the guide carriage 17B via a pivot joint 3C. A second lever arm of the lever 3, as represented in FIGS. 1A-C, is dispensed with, because the fraction band 11 engages directly on the guide carriage 17B. The function of the release movement means 7, which again substantially comprises the levers 3 and 4, is the same as in the embodiment example according to FIGS. 1A-C. In the embodiment example according to FIGS. 2A-C, the stopping means, for one of the two guide elements 17A or 17B, are in themselves expendable, because the force required for the release movement is greater than the force required for raising the lower door end. An abutment 6 on the guide carriage 17B ensures that a desired minimal separation b' (see FIG. 2C) is maintained.

FIGS. 2A-C show, furthermore, how a remote controlled locking and unlocking means 40B can be implemented. For this purpose, the (lower) pivot joint 2 of the lower folding shutter element 12B is provided with an oblong hole 19. This leads to the following: during a first raising of the guide carriage 17B, upward out of the locking position shown in FIG. 2A, the rotation point of the pivot joint 2 is first displaced upward up to the abutment end of the oblong hole. In addition, to the pivot joint 2, a thrust rod 21 is coupled, which, by means of an appropriate pivoting mechanism, pivots a locking lever 40B" into the unlocking position shown in FIG. 2. In this embodiment example, the free end of the locking lever 40B" is also used as a collapsing means. For this purpose, it has a roller 24D, which itself is known, and which is supported on the guide rail 16A.

Finally, it is apparent from FIG. 2C that, in the completely open state, the largest possible lateral separation a' of the lower edge of the lower folding shutter element 12B and of the guide rail 16A is maintained. The separation b' of the two guide elements 17A, 17B is the minimum possible or allowed separation. Overall, a very small packet size of the two folding shutter elements 12A, 12B in the completely opened state is achieved.

As can be seen in FIGS. 2A-2C, the pivot point 2 is raised and lowered with respect to the center of gravity of the guide elements 17A, 17B, when the latter move toward each other or apart from each other. The displacement 7 is thus simultaneously also a release movement means 7A and a raising means 7B.

Figure 3B:
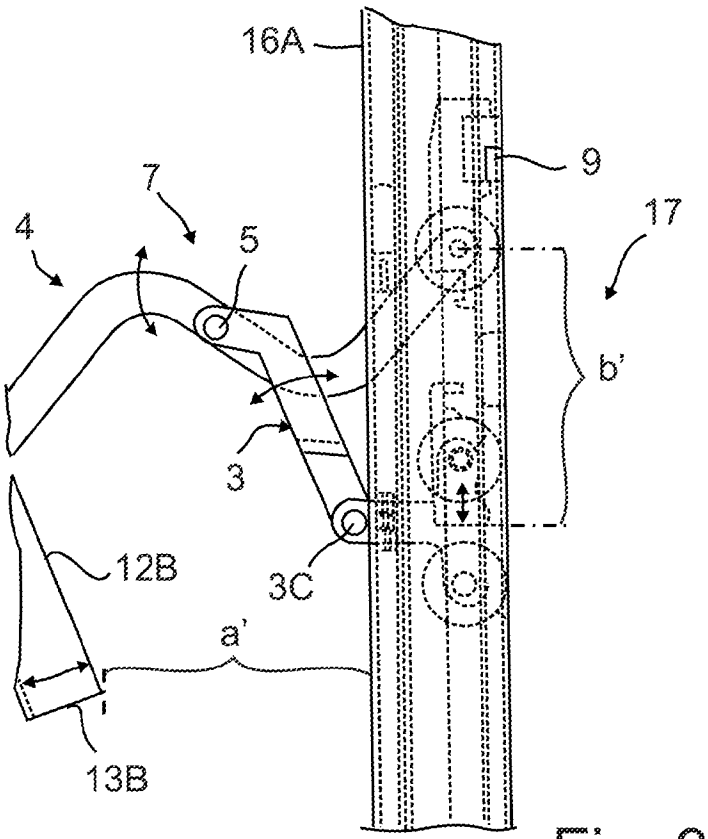
Figure 3A:
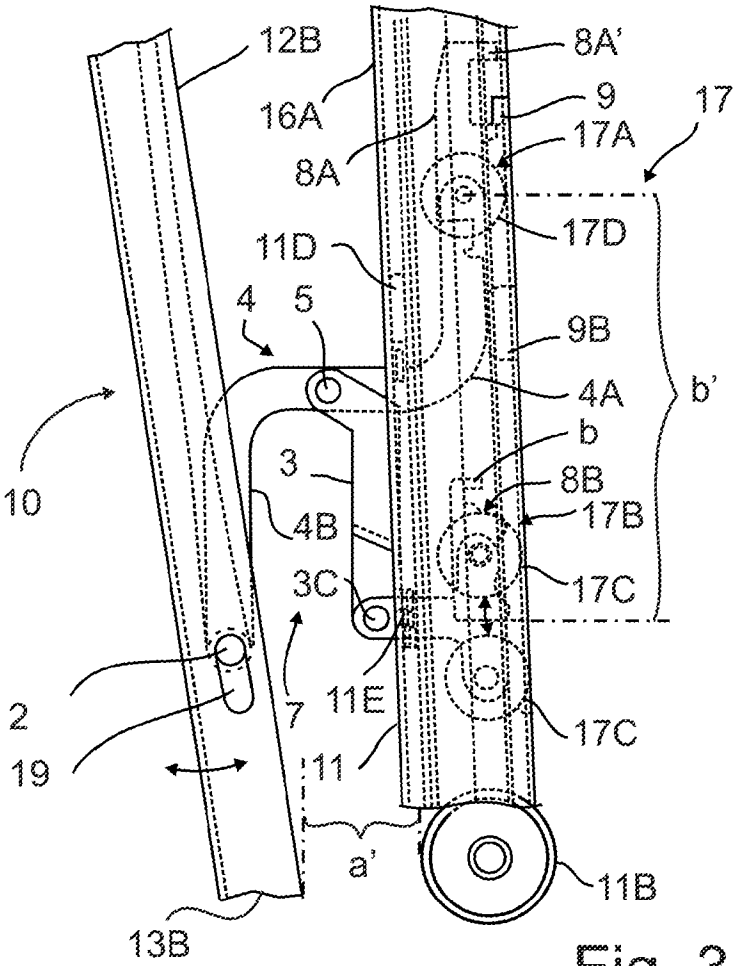

FIGS. 3A-3D show a version pertaining to the previous embodiment example which has been completed with a stopping means for at least one of the guide elements. As can be seen in FIG. 3A, which shows the state at the end of the unlocking phase and at the beginning of the release movement phase, a first stopping means 8A is pivotably arranged on the first guide element 17A in such a manner that a pivotable, spring-loaded stopping lever 8A', in its rest position, comes to be applied against a guide rail-side abutment 9, so that the further raising movement of the lower guide carriage 17B, after the unlocking has been completed, first allows merely the outward pivoting (release movement) of the two-armed lever 4. Frictional resistances that potentially occur, even if they are relatively high, can thus not lead to the upper guide element 17B moving upward already in this movement phase, in the sense of an appreciable raising of the folding shutter element, as is evident from a comparison of FIGS. 3A and 3B.

An additional stopping means 8B is provided, which is in a pivotable and spring-loaded arrangement on the guide carriage 17B, and which can have guide surfaces, and which can be pivoted, during a bypassing movement, on a guide cam 9B of the guide rail 16A against the spring force. As a result, the (upper) end area of the lower stopping means 8B can engage with the lower end area of the upper stopping means 8A, in order to ensure, in a later movement phase, namely during the closing of the door, that, even if increased friction forces or the like occur, the two guide elements 17A and 17B can be moved downward together, in that the traction band 11 pulls the guide carriage 17B downward, and the upper guide element 17A necessarily must follow this. The abutment 6 for fixing a minimum separation between the guide elements 17A and 17B can be formed on the stopping means 8B, as can be seen in FIG. 3D.

Figure 3D:
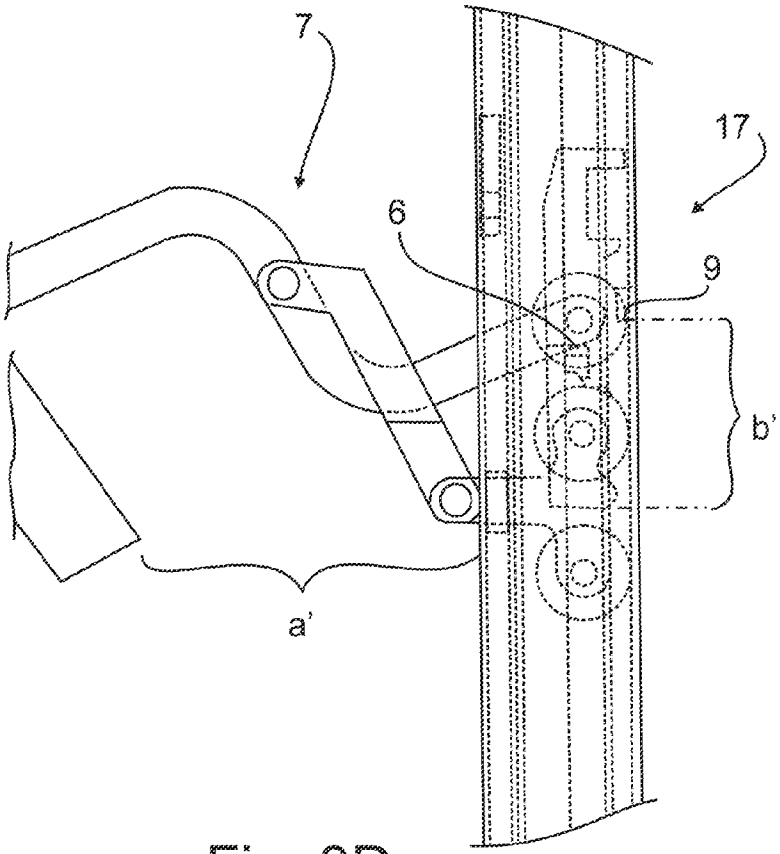
Figure 3C:
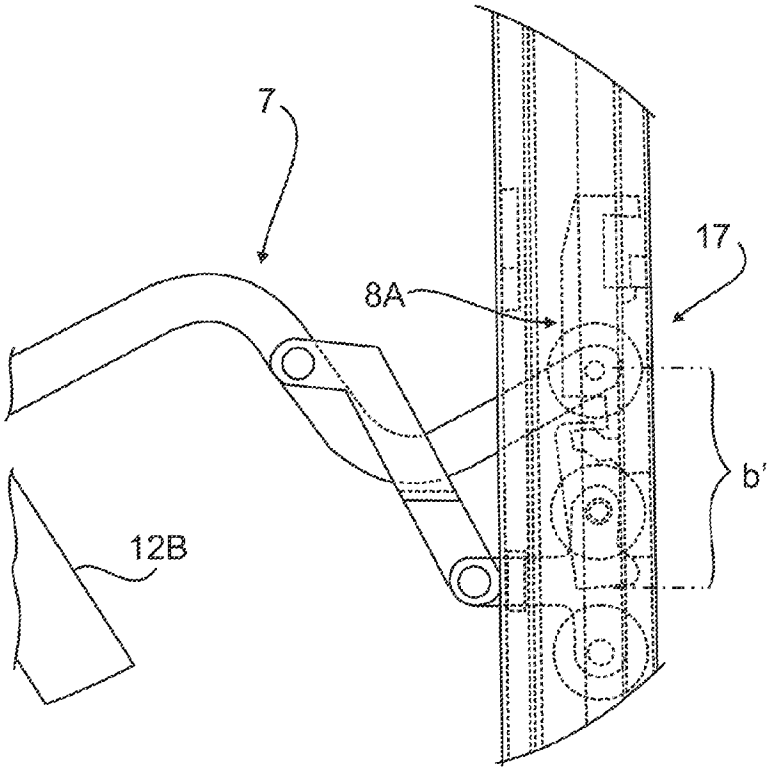

The pivoting means provided on the stopping means 8B, in engagement with the guide cam 9B, can trigger a brief pivoting of the stopping means 8A during the continued raising of the guide carriage 17B above the height level shown in FIG. 3C, so that the stopping provided there on the abutment 9 is suspended, and the two guide elements 17A and 17B can be moved together and at equal speed further upward, as can be seen in FIG. 3D.

According to FIGS. 3A-3D as well, the pivot point 2 is raised and lowered with respect to the center of gravity of the guide elements 17A, 17B, when the latter move toward each other or apart from each other. The displacement means 7 is thus simultaneously a release movement means 7A and a raising means 7B.

Figure 4A:
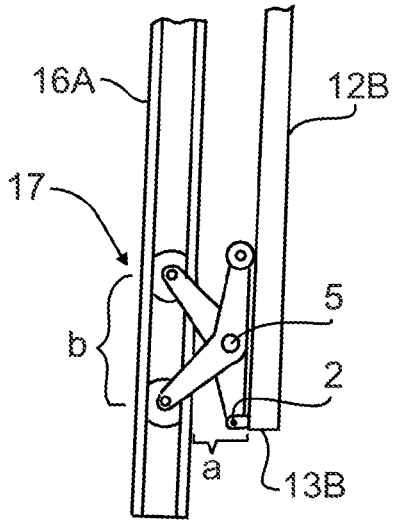
FIGS. 4A-C show a fourth embodiment example of a folding shutter arrangement showing purely diagrammatically, in a manner similar to FIGS. 1A-1C, and in sections, the three phases: the closed state in FIG. 4A, the moved away state in FIG. 4B, and the partially opened state in FIG. 4C.
Figure 4B:
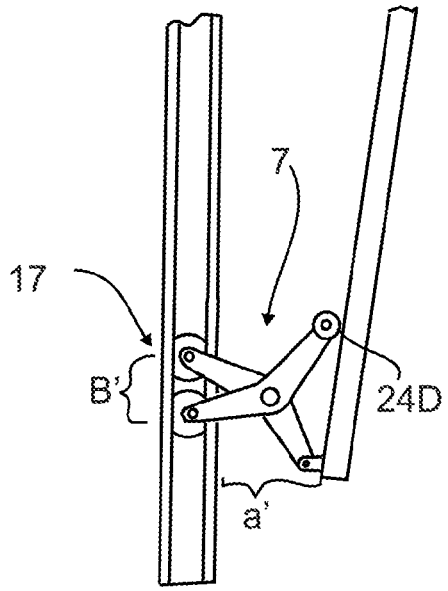
Figure 4C:
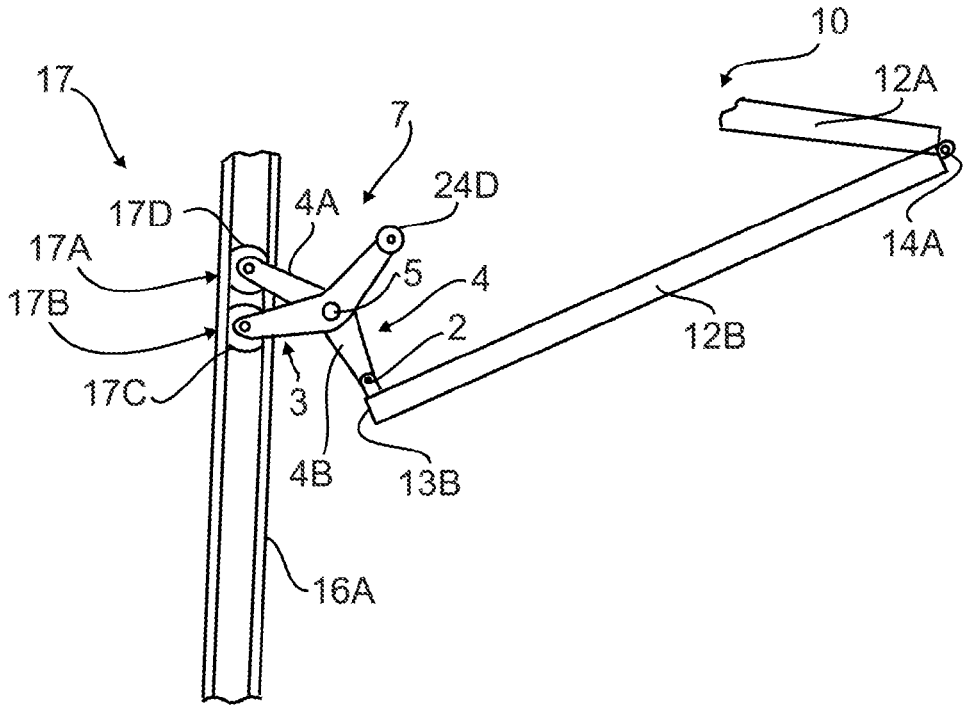

The embodiment example according to FIGS. 4A-4C shows that, in a variant of the embodiment example according to FIGS. 1A-1C, the lever 3 provided on the lower guide element 17B can be a collapsing means in the form of a roller 24D provided on a lever arm.

Figure 5A:
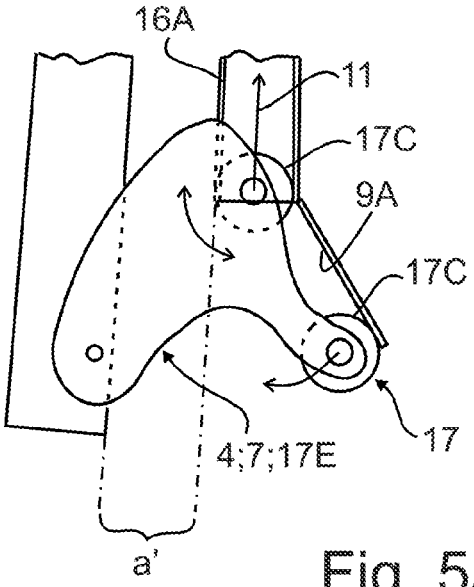
FIGS. 5A-C show a fifth embodiment example of a folding shutter arrangement in a diagrammatic representation similar to FIGS. 1A-C and 4A-C, wherein again 5A shows the closed state, FIG. 5B an intermediate position during the release movement phase, and FIG. 5C the situation immediately after the beginning of the main phase of the opening of the door.
Figure 5B:
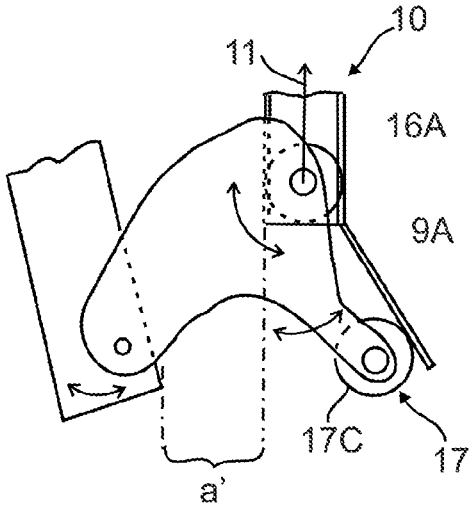
Figure 5C:
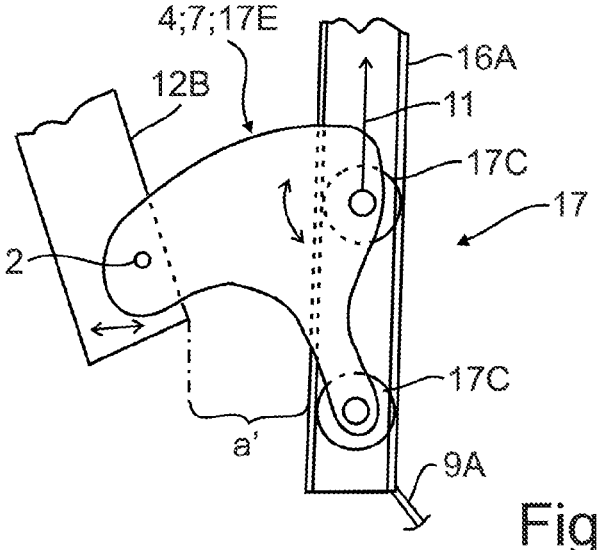

According to the further embodiment example according to FIGS. 5A-5C, a displacement 7 is visible, which works without separation changing guide elements, and which is pivotable in the start phase by means of a stop bevel 9A with respect to the guide rail 16A. In the closed starting position shown in FIG. 5A, the upper of two tandem castors 17C of guide carriage 17B, which also comprises the displacement means 7, is mounted laterally securely in the guide rail 17A. If now, in an appropriate manner, the guide carriage 17B is raised, for example, by means of a circulating or windable traction band 11, which engages on the guide carriage 17B, then the lower tandem castor 17C rolls off the stop bevel 9A and in the process it comes closer to the end of the guide trail 16A, which is open downward. As a result, the guide carriage 17B pivots (clockwise in the drawing). As shown in FIG. 5B, this leads to an increase in the separation a of the lower area of the folding shutter element 12B from the guide rail 16A. The separation increases with increasing pivoting of the guide carriage 17B, around the upper tandem castor 17C which is used as a center of rotation. As soon as the lower tandem castor 17C has also run into the guide rail 16A, the operation of increasing the separation of the release movement is terminated, and the guide carriage 17B now travels at constant separation of the lower end of the folding shutter element 12B from the guide rail 16A into the open position.

In the embodiment example according to FIGS. 5A-5C, the pivot point 2 is also raised and lowered with respect to the center of gravity of the guide elements 17A, 17B, when the latter continue to move past each other or apart from each other. The displacement means 7 is thus simultaneously a release movement means 7A and a raising means 7B.

Figures 6, 7:
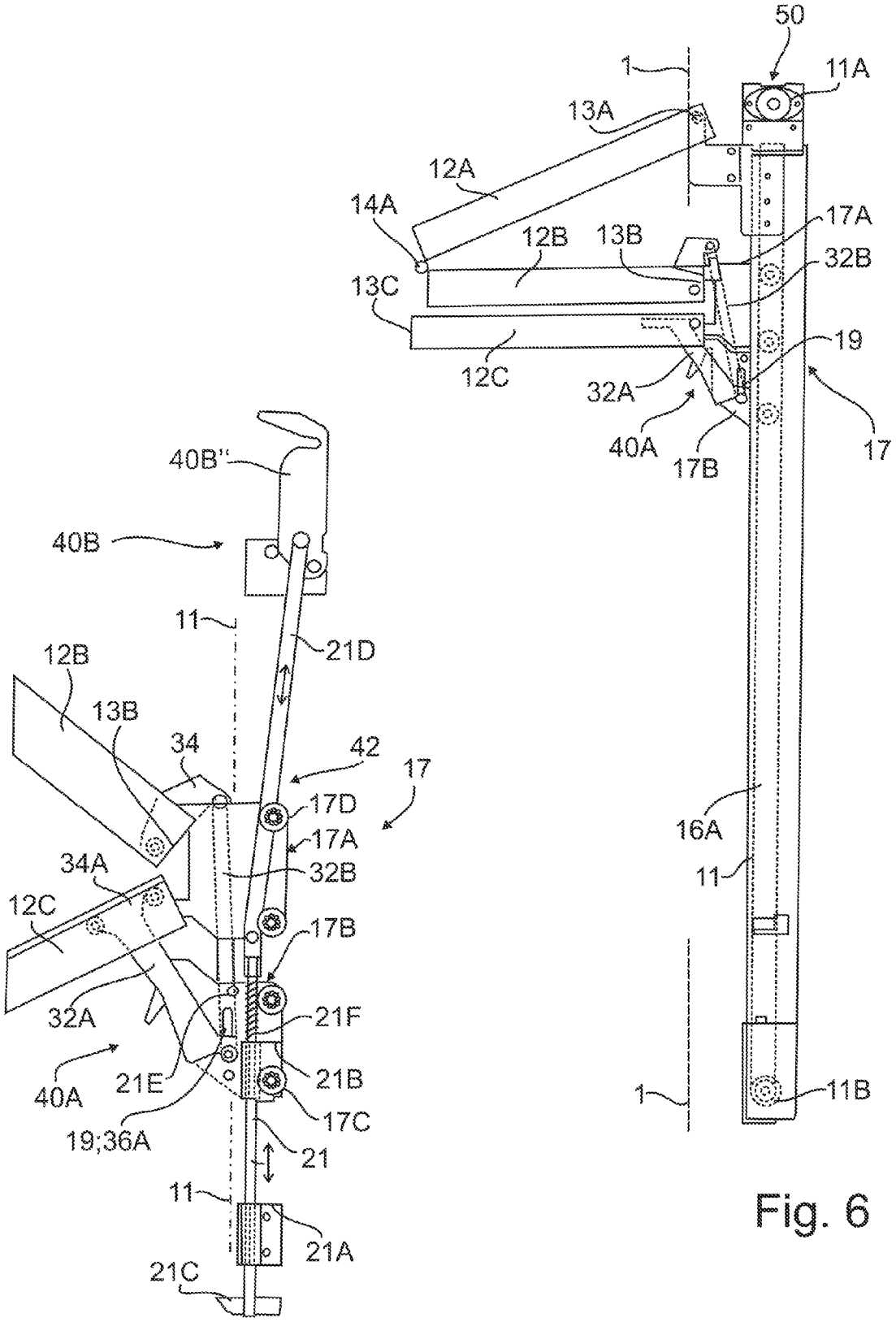
FIG. 6 shows a sixth embodiment example in the opened state of the folding door.
FIG. 7 shows a seventh embodiment example in the partially opened state of the folding door.
Figure 8A:
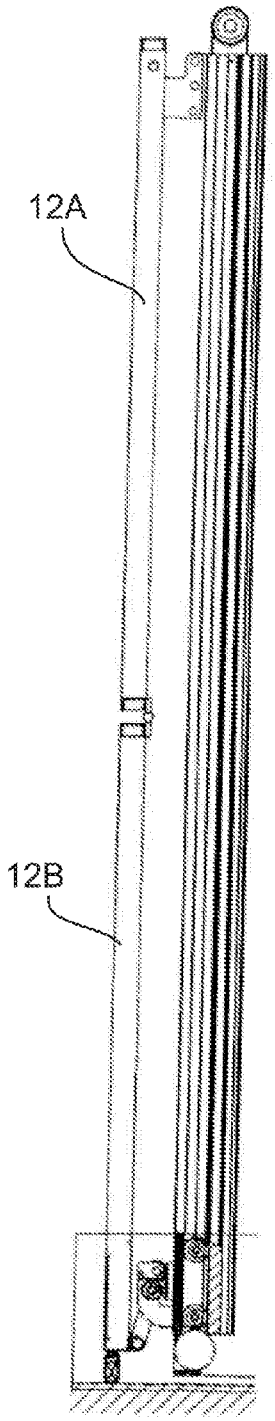
FIGS. 8A-D show an eighth embodiment example in various opening states of the folding door.
Figure 8B:
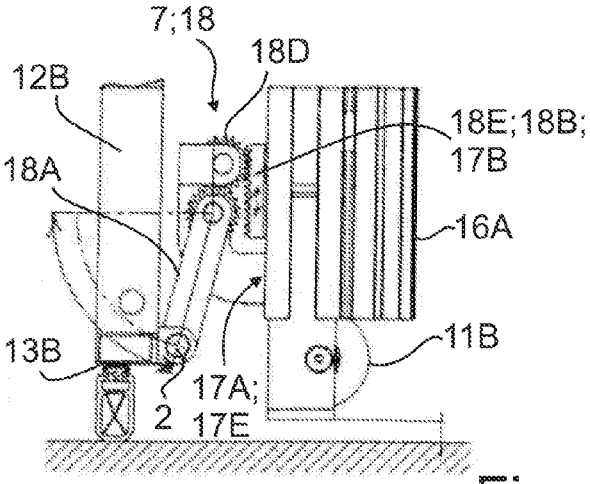
Figure 8C:
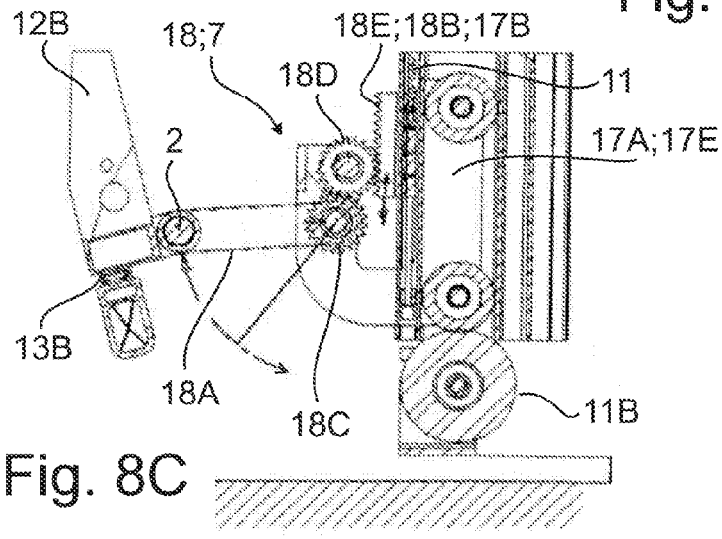
Figure 8D:
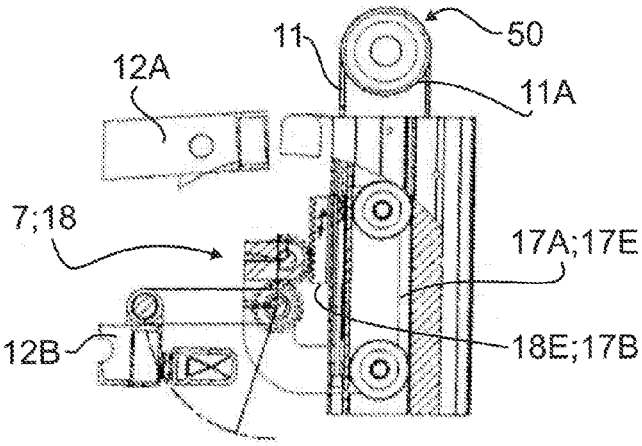

In the case of the three-element embodiment of a folding door according to FIG. 6, one of two guides 16A, 16B which stand vertical and are separated in parallel from each other can be seen, in which a first guide carriage 17A and a second guide carriage 17B can be moved vertically. The uppermost of three folding shutter elements 12A, 12B and 12C is indirectly attached, close to the first (uppermost) element edge 13A, pivotably around a fixed axle on a building 1 which is merely indicated. A second folding shutter element 12B is held pivotably around a second axle which can be displaced transversely to itself, close to a noncollapsing second element edge 13B, such that it is pivotable with respect to the first guide carriage 17A. The second, noncollapsing element edge 13B can be displaced vertically (indirectly) along the guides 16A, 16B, which are arranged in pairs at a right angle to the second element edge 13B, by means of the guide carriages 17A. The neighboring folding elements 12A and 12B form a (first) folding shutter element pair. The folding shutter elements are pivotably connected in pairs to each other at their collapsing third element edges, which are located parallel to and opposite the first and second element edges 13A, 13B, by means of a collapsing joint 14A. An additional (third) folding element 12C follows directly after the folding element pair 12A, 12B on the end side, as the last (lower) folding element, and it has a freely protruding element edge 13C. The third folding shutter element 12C is mounted pivotably and freely protruding, close to its upper element edge, around a pivot bearing, which is located on the guide carriage 17A.

The actuation of the folding shutter arrangement then occurs as follows: At the second (lower) guide carriage 17B, which can be moved vertically along the guides 16A or 16B, over the tandem castors 17C, which can each be configured as double castors, a drive element engages, such as a traction band 11, and particularly a toothed belt that runs around the upper and lower deflection rollers 11A, 11B, or a toothed belt/rope combination thereof: The traction band 11 can be driven in the area of an upper and/or lower deflection roller 11A, 11B in the two directions, particularly by an electric motor 50. The drive means and the oblong guide carriage 17B overall are referred to as the drive element. A first coupling element 32A and a second coupling element 32B are each attached pivotably to the second guide carriage 17B. As first coupling element 32A, a thrust rod is used, which is attached by means of its lower pivotable pivot point to the second guide carriage 17B, and with its upper pivotable pivot point to the third folding shutter element 12C, so that a swivel arm is produced, and the first coupling element 32A as a result can apply a torque to the third folding shutter element 12C. The second coupling element 32B is also configured as a thrust rod and it is pivotably connected, for example, at the same pivot point to the second guide carriage 17B, like the first coupling element. At its second, upper end, the second coupling element 32B engages on a pivot arm. Said pivot arm is rigidly, i.e., nonpivotably, connected to the second folding shutter element 12B in the lower area thereof, so that the pivot arm applies a torque to the second folding shutter element 12B. The drive means thus engages only indirectly on the first guide carriage 17A, namely by means of the second coupling element 32B and of the pivot arm. Thus, the first guide carriage 17A is raised and lowered indirectly via the movement of the second guide carriage 17B.

If then the second guide carriage 17B is moved upward, out of the closed and locked extended position, then, during the initial movement, only a lower locking and unlocking means 40A is disengaged. This locking and unlocking means 40A comprises a short boom with a locking cutout and a fixed locking abutment which is not shown. The boom has an oblong hole 19, in which the lower centers of gravity of the first and second coupling elements 32A and 32B can be shifted by a sufficient distance. During the initial opening movement of the second guide carriage 17B, these centers of gravity are shifted downward with respect to the boom in the oblong hole 19, while the locking cutout moves upward and finally releases the locking abutment. An additional upward movement of the second guide carriage 17B leads to a raising of the two coupling elements 32A and 32B. This in turn leads to the first coupling element 32A pivoting the lower folding shutter element 12C outward, and the second coupling element 32B pivoting the pivot arm 34 around the second folding shutter element 12B, i.e., from an extended position into a slightly collapsed position. As soon as the second folding shutter element 12B has collapsed out of its extended position into a slightly collapsed position, the first guide carriage 17A can be displaced upwards under the raising action of the first and second coupling elements 32A and 32B along the guides 16A, 16B. In the process, the collapsing movement of the folding shutter element continues. At the same time, the first folding shutter element 12A is pivoted outward around the first axle, as a result of the collapsing movement of the second folding shutter element 12B and indirectly by means of the second coupling element 32B. The first guide carriage 17A and the three folding shutter elements 12A-C then follow the raising movement of the second guide carriage 17B. The second and third folding shutter elements 12B and 12C are thus forcibly pivoted in pairs by the drive element 30, and as a result the first folding shutter element 12A is also forced to pivot into the open position shown in FIG. 6.

During the closing of the folding shutter arrangement, the second guide carrier 17B is lowered, and the first guide carriage 17A follows this movement due its own weight, and supported by the weight of the three folding shutter elements 12A-12C.

It can be seen in the seventh embodiment example according to FIG. 7 how a locking and unlocking, in particular a second locking and unlocking, and in the embodiment example an upper locking and unlocking, can be actuated by the traction band 11: Two thrust rod guides 21A, 21B attached to the respective guide 16A or 16B, in a sliding manner and approximately parallel to the guides, lead a thrust rod 21 with a, in particular lower, abutment 21C and a, in particular upper, thrust rod extension 21D, which is connected either intrinsically flexibly, or it is connected slightly pivotably to the thrust rod 21. At its, in the example upper, end, the thrust rod extension 21D is connected pivotably to a locking and unlocking lever 40B" in a drive direction, so that overall a, in the example an upper, locking and unlocking means 40B is implemented, which can be operated remotely by means of an extension means that overall bears the reference numeral 42, and can engage with a locking effect in a locking abutment (not shown) on one of the folding shutter elements. A compression spring 21F loads the upper locking and unlocking means 40B in the direction of an unlocking position, as shown in FIG. 7. The drive element on which the abutment 21E is provided is used for the locking; at the end of the closing movement, said abutment comes to be applied, against the abutment 21C, and, in the locking phase of the lower locking and unlocking means 40A, it simultaneously shifts the extension means 42 downward, so that the upper locking and unlocking means 40B also reaches its locking position.

In a further embodiment example according to FIGS. 8A-8D, a transmission 18 is used as displacement means 7, which can be configured, for example, as a lever transmission, in particular as an elbow lever mechanism. In the represented embodiment example, it is configured as a gear transmission. On a first guide element 17A, which is configured as a guide carriage 17E, a lever 18A is pivotably mounted, which at the other end engages at the pivot point 2 close to the door element edge 13B. At its guide carriage-side end, the lever 18A is rotatably provided with a first gear ring 18C, which, for reasons pertaining to the reversal of direction, also engages with the second gear ring 18D which is rotatably mounted on the guide carriage 17E. On the guide carriage 17E, along a free travel path, a linear transmission portion is arranged in the form of a gear rod 18E in a manner so that it can be displaced longitudinally, so that it engages with the second transmission gear wheel 18D. This toothed rod which is used as linear drive means 18B, is attached to the raising and lowering means of the door, in particular to a traction band 11 or a toothed belt, which is actuated so that it circulates on the upper guide rail end by a drive motor 50 (as also, for example, in the previous embodiment examples). Due to the free travel path, the toothed rod 17E is first raised by this drive unit during the opening process, along its free travel path in the guide carriage 18E, and thus the displacement means 7 is actuated. After an approximately 90° pivoting of the transmission lever 18A, the toothed rod 18E engages at the end of the free travel path in the raising direction on the guide carriage 17E, and thus it ends the relative movement toward the guide carriage, and also the displacement of the displacement means, so that the pivot point 2 remains at a fixed separation from the guide rails 16A/B. During the lowering of the door, the process is reversed, wherein the weight of the door ensures that the guide carriage 17E is lowered, while the toothed rod 18E continues to remain at the upper abutment of the free travel path. It can be supported by control or stopping that are not shown in the drawing. It is only when the lowering movement is completed that the actuation of the displacement means 7 occurs, wherein the transmission lever 18A is pivoted downward by approximately 90°.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A folding door comprising:

two or more intrinsically rigid folding shutter elements, each comprising alternating noncollapsing and collapsing door element edges, at least one guide means which can be raised and lowered on or in one or more guide rails to thereby raise and lower a permanently guide rail-adjacent, noncollapsing door element edge of one of the two or more shutter elements, wherein the permanently guide rail-adjacent, noncollapsing door element edge includes at least one pivot point, a displacement means which is active between the at least one pivot point and the at least one guide means to thereby change a distance between the at least one pivot point and the at least one guide means at a beginning of an opening of the folding door, as well as at an end of a closing of the folding door;

wherein:

the at least one guide means comprises at least two guide elements, during the opening of the door, the at least two guide elements first move towards each other to a minimum guide element spacing between the at least two guide elements thereby performing a first door actuation accompanying the opening of the door by increasing the distance between the at least one pivot point and the one or more guide rails, the at least two guide elements moving together at the minimum guide element spacing for the completion of the opening of the door, and during the closing of the door, the at least two guide elements first move together at the minimum guide element spacing and then move apart from each other and perform a second door actuation accompanying the end of the closing of the door by decreasing the distance between the at least one pivot point and the one or more guide rails.

2. The folding door according to claim 1, wherein the displacement means comprises at least one of a release movement means or a raising means.

3. The folding door according to claim 2, wherein the displacement means includes a pivoting lever.

4. The folding door according to claim 2, wherein the displacement means includes the release movement means and the release movement means moves the permanently guide rail-adjacent noncollapsing door element edge away from the one or more guide rails at the beginning of the opening of the folding door, and moves the permanently guide rail-adjacent noncollapsing door element edge toward the one or more guide rails at the end of the closing of the folding door.

5. The folding door according to claim 2, wherein the displacement means includes the raising means and the raising means raises the at least one pivot point with respect to the at least one guide means at the beginning of the opening of the folding door, and lowers the pivot point with respect to the at least one guide means at the end of the closing of the folding door.

6. The folding door according to claim 1, wherein the at least one guide means includes a guide carriage, the guide carriage including at least one of tandem castors or double castors.

7. The folding door according to claim 1, wherein the first door actuation accompanying the opening of the door comprises at least one of an unlocking of the folding door, a collapsing of the folding door out of an extended position, a forced pivoting of at least one of the folding shutter elements, or a release movement of the permanently guide rail-adjacent noncollapsing door element edge away from the one or more guide rails.

8. The folding door according to claim 1, wherein the first door actuation accompanying the closing of the door comprises at least one of a locking of the folding door, a pulling of the folding door into an extended position, a forced pivoting of at least one of the folding shutter elements, or a movement of the permanently guide rail-adjacent noncollapsing door element edge toward the one or more guide rails.

9. The folding door according to claim 1, wherein at least one abutment ensures a minimum separation of the at least two guide elements as the at least two guide elements move toward each other.

10. The folding door according to claim 1, further including a stopping means, provided to hold one of the at least two guide elements with respect to the one or more guide rails as the at least two guide elements move toward each other.

11. The folding door according to claim 1, further including at least one stopping means, provided to hold the at least two guide elements together during at least one of the opening or the closing of the folding door.

12. An actuation device for a folding door that includes two or more intrinsically rigid folding shutter elements, each comprising alternating noncollapsing and collapsing door element edges, the folding door including at least one guide means which can be raised and lowered on or in one or more guide rails to thereby raise and lower a permanently guide rail-adjacent, noncollapsing door element edge of one of the two or more shutter elements, the permanently guide rail-adjacent, noncollapsing door element edge including at least one pivot point, the actuation device comprising a displacement means which is active between the at least one pivot point and the at least one guide means to thereby change a distance between the at least one pivot point and the at least one guide means at a beginning of an opening of the folding door, as well as at an end of a closing of the folding door;

wherein:

the at least one guide means comprises at least two guide elements, during the opening of the door, the at least two guide elements first move towards each other to a minimum guide element spacing between the at least two guide elements thereby performing a first door actuation accompanying the opening of the door by increasing the distance between the at least one pivot point and the one or more guide rails, the at least two guide elements moving together at the minimum guide element spacing for the completion of the opening of the door, and during the closing of the door, the at least two guide elements first move together at the minimum guide element spacing and then move apart from each other and perform a second door actuation accompanying the end of the closing of the door by decreasing the distance between the at least one pivot point and the one or more guide rails.

13. A method for actuating the folding door of claim 1, the method including actuating the displacement means to thereby move the at least one pivot point away from the one or more guide rails at the beginning of the opening of the folding door and actuating the displacement means to thereby move the at least one pivot point toward the one or more guide rails at the end of the closing of the folding door.

14. The method according to claim 13, further including moving the at least two guide elements during the opening of the door toward each other at least along a partial section of an opening path and toward a minimum guide element spacing between the at least two guide elements, thereby performing the first door actuation accompanying the opening of the door, and moving the at least two guide elements during the closing of the door apart from each other at least along a partial section of a closing path, thereby performing the second door actuation accompanying the closing of the door.

* * * * *

UNITED STATES PATENT AND TRADEMARK OFFICE

CERTIFICATE OF CORRECTION

PATENT NO. : 9,255,430 B2
APPLICATION NO. : 13/782548
DATED : February 9, 2016
INVENTOR(S) : Bernhard Lucas It is certified that error appears in the above-identified patent and that said Letters Patent is hereby corrected as shown below:

In the Claims

Col. 12, line 33, Claim 8, the word "first" should be replaced with --second--.

Signed and Sealed this
Third Day of May, 2016

Michelle K. Lee

Michelle K. Lee
*Director of the United States Patent and Trademark Office*